United States Patent [19]

Haneda et al.

[11] Patent Number: 5,030,988

[45] Date of Patent: Jul. 9, 1991

[54] COLOR IMAGE FORMING APPARATUS

[75] Inventors: Satoshi Haneda; Masakazu Fukuchi; Seiko Naganuma; Masahiko Itaya; Shunji Matsuo; Shizuo Morita, all of Hachioji, Japan

[73] Assignee: Konica Corporation, Tokyo, Japan

[21] Appl. No.: 500,078

[22] Filed: Mar. 27, 1990

[30] Foreign Application Priority Data

Apr. 3, 1989 [JP] Japan ..... 1-85048

[51] Int. Cl.[5] ..... G03G 15/00

[52] U.S. Cl. ..... 355/200; 355/210; 355/211; 355/298; 355/326

[58] Field of Search ..... 355/200, 210, 211, 251, 355/298, 326, 327, 260

[56] References Cited

U.S. PATENT DOCUMENTS

| | | | |
|---|---|---|---|
| 4,389,113 | 6/1983 | Matsumoto et al. | 355/251 |
| 4,696,565 | 9/1987 | Imanaka | 355/298 |

FOREIGN PATENT DOCUMENTS

| | | | |
|---|---|---|---|
| 0276910 | 8/1988 | European Pat. Off. | 355/210 |
| 6155661 | 8/1984 | Japan . | |
| 0210951 | 9/1988 | Japan | 355/210 |

*Primary Examiner*—A. T. Grimley
*Assistant Examiner*—Christopher Horgan
*Attorney, Agent, or Firm*—Jordan B. Bierman

[57] ABSTRACT

A color image forming apparatus for forming a plurality of toner images on a rotating image retainer, wherein the image retainer, a group of developing devices disposed below the image retainer and a cleaning device disposed above the image retainer are integrated to constitute a process unit, toner recovered by the cleaning device is stored in the process unit, and the image retainer can be removed from the process unit.

5 Claims, 5 Drawing Sheets

COLOR IMAGE FORMING APPARATUS

BACKGROUND OF THE INVENTION

1. Field of the Invention

This invention relates to a color image forming apparatus in electrophotography. More particularly, the present invention relates to a color image forming apparatus which is compact in size and has an improved maintenance property and improved performance for jam processing.

2. Description of the Prior Art

In an electrophotographic image forming apparatus for forming multi-color images such as full color images or functional color images, a charging device for charging a photosensitive drum as an image retainer, image exposure means for exposing images on the photosensitive drum, developing devices for developing an electrostatic image on the photosensitive drum with a toner, transfer device for transferring a toner image on the photosensitive drum onto recording paper, and the like, are disposed around the photosensitive drum.

Among them, the developing device in the electrophotographic image forming apparatus for the full color image consists of three or four developing devices for storing the toners of yellow (Y), Magenta (M) and cyan (C) and, in some cases, black (BK). Each toner image of the yellow (Y), Magenta (M) and cyan (C) and in some cases, black (BK), is formed on the photosensitive drum while it rotates three times or four times, and each toner image is transferred to recording paper to obtain the full color image. In such an image forming system, the color image forming apparatus can be made compact by reducing the width of the three or four developing devices and disposing them closely adjacent to one another.

In Japanese Patent Laid-Open No. 55661/1986, a color image forming apparatus in accordance with such an image forming system is proposed. Latent images are formed by three exposure means corresponding to three developing devices, respectively, and the photosensitive drum, the developing devices and cleaning means are integrated as one unit so that the unit can be taken out from an apparatus main body. On the other hand, Japanese Patent Application No. 320596/1987 discloses an apparatus in which one exposure means is used, developing devices are arranged in superposition with one another and integrated as one unit in the same way as described above so that the integrated unit can be taken out from the apparatus main body.

In the above-mentioned color image forming apparatuses described in Japanese Patent Laid-Open No. 55661/1986 and Japanese Patent Application No. 320596/1987, the maintenance property can be improved. It is true, but spill and false mixing of developers are likely to occur when the unit is fitted to, or removed from, the apparatus main body.

In color image forming apparatuses for transferring each color toner image to recording paper by use of a transfer drum, Japanese Patent Laid-Open No. 72159/1983 discloses an apparatus wherein devices around the photosensitive drum are integrated as one unit.

However, the color image forming apparatus disclosed in this Japanese Patent Laid-Open No. 72159/1983 is not free from the following drawbacks.

(1) The image forming portion extends not only to the periphery of the photosensitive drum but also to the transfer drum.

(2) A high level of accuracy must be secured in the peripheral speeds and the gap between the photosensitive drum and the transfer drum.

(3) A release mechanism is necessary in order to take out the photosensitive drum.

In the color image forming apparatus using the transfer drum described above, the mechanism gets complicated as described in items (2) and (3) and the cost of production becomes high. Moreover, image forming means are not concentrated around the photosensitive drum in the same way as in a monochromatic image forming means which does not require a transfer drum, and the merits brought about by the integration into one unit (process unit) of the image forming portions cannot be obtained sufficiently.

SUMMARY OF THE INVENTION

It is an object of the present invention to provide a color image forming apparatus which employs a cartridge structure wherein a developing unit, an image retainer and cleaning means are integrated as one unit or at least two of them are integrated as one unit, and the unit is fittable or removable independently in order to improve a maintenance property, which employs a structure wherein a plurality of developing devices are integrated as a unit in order to prevent spill of developers to the outside or false mixing into other developing devices when this process unit is fitted to, or removed from, an apparatus main body, and which makes it easy to make jam processing when transfer failure of recording paper to be transferred occurs.

It is another object of the present invention to provide a color image forming apparatus employing the process for forming a composite toner image such as color toner image consisting of a plurality of color toners on the surface of a photosensitive drum and transferring them altogether to recording paper, in which concentratedly a plurality of developing devices as image forming means and cleaning means are provided around the photosensitive drum in order to make the apparatus small and compact in size, and integrated together into a process unit which can be fitted to, and removed from, an apparatus main body, and this compact process unit is provided with the functions such as exchange, discharge, and store considerable quantities of the toners recovered by the cleaning means in the process unit.

A color image forming apparatus for forming a plurality of toner images on a rotating image retainer by repeating a plurality of times charging and image exposure and developing onto the image retainer, and for transferring the toner images onto recording paper of the present invention is characterized in that the image retainer, a group of developing devices disposed below the image retainer and a cleaning device disposed above the image retainer are integrated so as to constitute a process unit, a toner recovered by the cleaning device is stored in the image retainer and the image retainer can be fitted to the process unit taken out from the apparatus main body from above, or be removed from the same upwardly.

The above and other objects and novel features of the present invention will become more apparent from the following detailed description in conjunction with the accompanying drawings.

DESCRIPTION OF THE PREFERRED EMBODIMENTS

A first embodiment of the present invention is shown in FIGS. 1 to 5.

Figure 1:
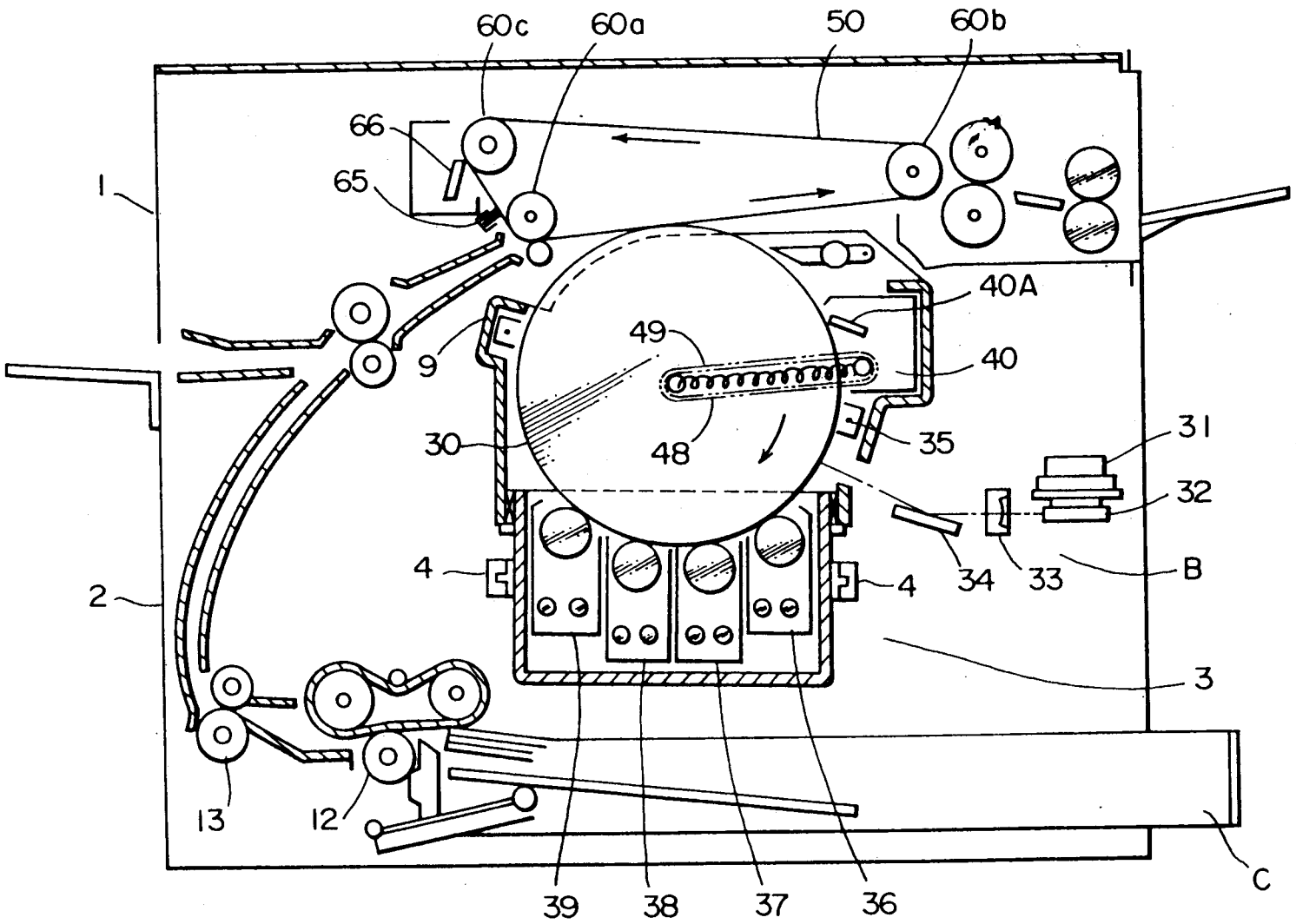
FIG. 1 is a sectional view of the structure of a color image forming apparatus of the present invention.

FIG. 1 shows an embodiment when the present invention is applied to a printer.

The printer employs a cram shell structure divided into an upper casing 1 including a transfer belt 50, and an apparatus main body 2 including a process unit. The upper casing 1 can be opened and held at a predetermined angle by hinges coupled to the apparatus main body 2, and be integrated in the closed state with the apparatus main body 2 by a fixing metal.

An image retainer 30 constituting an image forming portion of the printer described above; developing devices 36, 37, 38, 39 storing developers of yellow, Magenta, cyan and black, respectively; a cleaning device 40 having a pressure attach/release mechanism for the image retainer; and a charging device 35 are stored as a unit in an integral process cartridge 3, and can be fitted into, and removed from, inside the apparatus main body 2 through a pair of guide members 4 engaging with the right and left outer side surfaces of the unit. In the present invention, each developing device 36, 37, 38, 39, in particular, is sequentially juxtaposed with each other from the upstream side below the image retainer 30 in such a manner as to face vertically the peripheral surface of the image retainer 30.

In other words, the process cartridge 3 can be fitted and loaded into the apparatus main body 2 in the direction of its depth by a handle 5 disposed on its front surface through the engagement of the guide members 4 described above, and when it is drawn out on this side, the engagement of the guide members 4 is released so that the process cartridge 3 can be removed in front of the apparatus main body 2. Since each developing device can keep at this time the posture with its opening up, the developer does not spill out nor drop, or does not either mix into other developing devices.

The printer described above includes also a laser write system unit B inside the space on the side of the process cartridge 3, and recording paper whose transfer surface is positioned at the portion bridging both the upper casing 1 above the process cartridge 3 and the apparatus main body 2. The image retainer 30 receives laser scanning by the laser write system unit B from a lower corner and transfers a color toner image formed in superposition on its peripheral surface to the lower surface of the recording paper.

The process of the color image copy by the printer described above is conducted in the following way.

Figure 4:
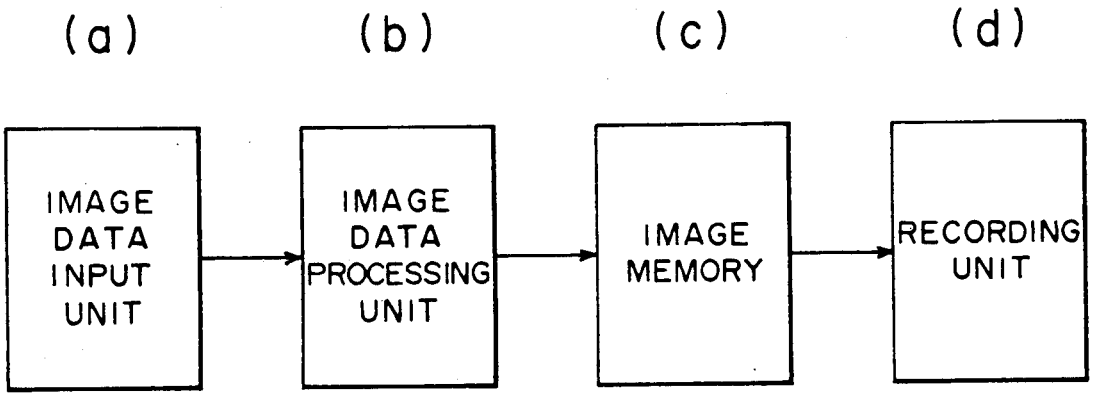
FIG. 4 is a block diagram showing an image forming system.

First of all, the formation of the multi-color image in this embodiment is carried out in accordance with the image forming system shown in FIG. 4. A color image data input unit (a) in which an imaging device scans an original image applies data to an image data processing unit (b) equipped with a computer. The image data processing unit processes the data and generates image data, which are then stored temporarily in an image memory (c). Then, the image data is read from the image memory at the time of recording and is inputted to the color image forming apparatus of a recording unit (d) shown in the embodiment of FIG. 1.

In other words, when the color signals outputted from an image reader as a separate unit from the printer described above are inputted to the laser write system unit B, a laser beam generated by a semiconductor laser (not shown) in this laser write system unit B is rotationally deflected by a polygonal mirror 32 rotated by a driving motor 31, and the beam passes through an $f\theta$ lens 33. The optical path is bent by a mirror 34. The laser beam is then irradiated onto the peripheral surface of the image retainer 30 which is in advance provided with charges by the charging device 35 as charging means, thereby forming bright lines.

When scanning is started, on the other hand, the beam is sensed by an index sensor and modulation of the beam by a first color signal is started so that the modulated beam scans the peripheral surface of the image retainer 30. Accordingly, a latent image corresponding to the first color is formed gradually on the peripheral surface of the image retainer 30 by the main scanning by the laser beam and sub-scanning by the revolution of the image retainer 30. This latent image is developed by the developing device 36 to which the yellow (Y) toner (developing medium) is loaded among the developing means. The toner image is thus formed on the drum surface. The resulted toner image passes below a cleaning device 40 as cleaning means which is spaced apart from the peripheral surface of the imager retainer 30, while held on the drum surface, and then enters the next copy cycle.

In other words, the image retainer 30 is charged once again by the charging device 35 described above. Next, the second color signal outputted from the signal processing unit is inputted to the write system unit B, and write is made on the drum surface in the same way as in the case of the first color signal described above, forming a latent image. This latent image is developed by the developing device 37 to which the Magenta (M) toner as the second color is loaded.

This Magenta (M) toner image is formed in the presence of the yellow (Y) toner image that has been formed previously.

By the developing device 38 containing the cyan (C) toner, the cyan (C) toner image is formed on the drum surface on the basis of the control signal generated by the signal processing unit.

Furthermore, by the developing device 39 containing the black toner, the black toner image is formed in superposition on the drum surface by the similar processing. A direct current bias and further an alternating current bias are applied to each sleeve of these developing devices 36, 37, 38, 39 so that jumping development is made by a two-component developer in a non-contact manner for the image retainer 30 whose base is grounded.

The color image formed in this manner on the peripheral surface of the image retainer 30 is transferred to the lower surface of recording paper that is sent from a paper feed cassette C through a paper feed roller 12 and a paper guide, at a transfer portion, after it is charged before transfer by a charging device 9.

In other words, this multi-color toner image is charged before transfer by the charging device 9 so as to make transfer easier, and the transfer belt 50 which is kept rotated from the start of transfer is brought into contact with the image retainer 30 so that the multi-color toner image is transferred to recording paper which is supplied from the paper feed cassette C through the paper feed roller 12 and a timing roller 13 while the paper feed timing is in match with that of the image formation.

The basic structure of the transfer belt 50 is as follows. A 0.5 mm-thick elastic material layer is disposed on the outer periphery of a rubber belt with a built-in conductive fabric and a 50 μm-thick insulator layer (dielectric layer) is provided further on the outer periphery of the elastic material layer. The transfer belt 50 is extended between the rollers 60*a*, 60*b*, 60*c*, rotated when the roller 60*a* is driven, and brought into contact with, or out of contact from, the image retainer 30 when the roller 60*b* moves up and down. Charging of the transfer belt 50 is made by a charging brush 65 or a corotron. Namely, transfer charges of about 1.5 KV to about 3.0 KV having an opposite polarity to that of the toner is applied to the surface of the transfer belt 50 and transfer is effected. Incidentally, reference numeral 66 represents a cleaning device which cleans the surface of the transfer belt 50.

On the other hand, a blade 40A of the cleaning device 40 described above comes into contact with the image retainer 30 from which recording paper has been separated and removes any residual toner therefrom. After this cleaning is complete, the blade is separated from the image retainer 30 and a new color image forming process is entered.

As described above, recording paper is transferred in the horizontal direction above the process cartridge 3, with its transfer surface down. Accordingly, even when the toner spills from the cleaning device 40 or the like or scatters, it does not contaminate the image forming surface.

Figure 2:
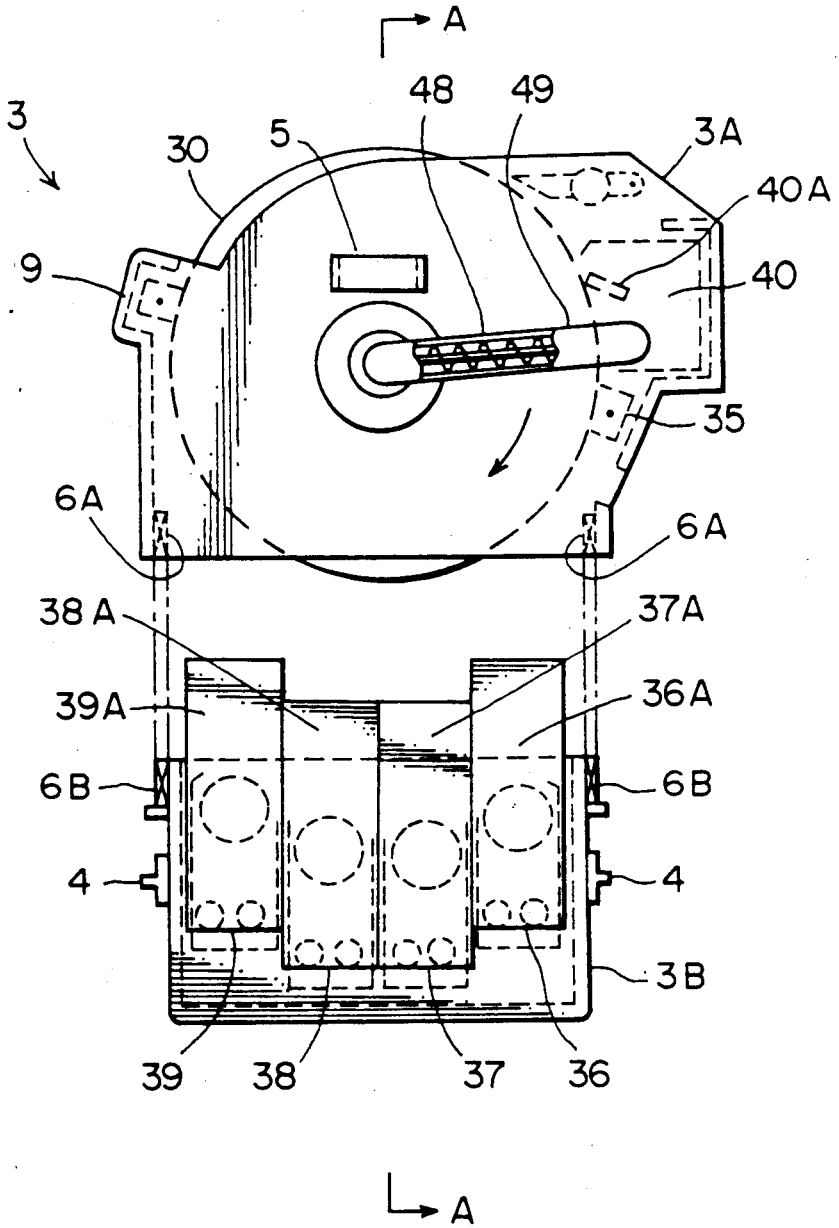
FIGS. 2 and 3 are a front view and a sectional view, of an essential portions, of a process cartridge stored in the apparatus described above.

FIG. 2 is a front view of the process cartridge 3 taken out from the apparatus main body and divided in the vertical direction. The handle 5 on the front surface is utilized in order to take out the process cartridge 3.

The process cartridge 3 consists of an upper cartridge 3A storing therein the image retainer 30, the cleaning device 40, the charging device 35, the pre-transfer charging device 9, etc., and a lower cartridge 3B storing therein the developing devices 36, 37, 38, 39 and equipped on its outer front surface with toner supply boxes 36A, 37A, 38A, 39A in the positions corresponding to the charging devices, respectively.

The upper cartridge 3A and the lower cartridge 3B are integrated by fitting and engagement between a pair each of key members 6A and shoe members 6B disposed on the right and left side surfaces, and can be divided from each other in the vertical direction as shown in FIG. 2 when the engagement is released.

In the state where the upper cartridge 3A and the lower cartridge 3B are integrated by the engagement, the developing devices 36, 37, 38, 39 are distributed to the right and left with respect to the center line of the image retainer 30. Namely, the developing devices 36 and 37 are disposed on the right side and the developing devices 38 and 39 are disposed on the left side, symmetrically with regard to the axis of the image retainer 30.

As a result, the balance of the weight of the process cartridge 3 can be easily attained in the lateral direction and the cartridge 3 becomes easier to handle. Moreover, the developing devices symmetrically disposed in the right and left positions can take the same structure. And as the developing devices are arranged in parallel, these are constructed into a compact process cartridge 3 and the balance of weight in the lateral direction can be attained.

In connection with the upper cartridge 3A, a toner transfer pipe 49 with a built-in toner transfer screw 48 is disposed on the front surface of the upper cartridge 3A between the image retainer 30 and the cleaning device 40 so that the waste toner scraped off from the peripheral surface of the image retainer 30 by the blade 40A is transferred by the propelling force of the toner transfer screw 48 and is recovered inside the drum of the image retainer 30.

A pipe member for connecting, formed of a synthetic resin material having high lubricability, is used for the toner transfer pipe 49 described above in order not to apply resistance or the like to the operation of the toner transfer screw 48.

On the other hand, the lower cartridge 3B is equipped with a device for supplementing the toner from each toner supply box to each developing device.

Figure 3:
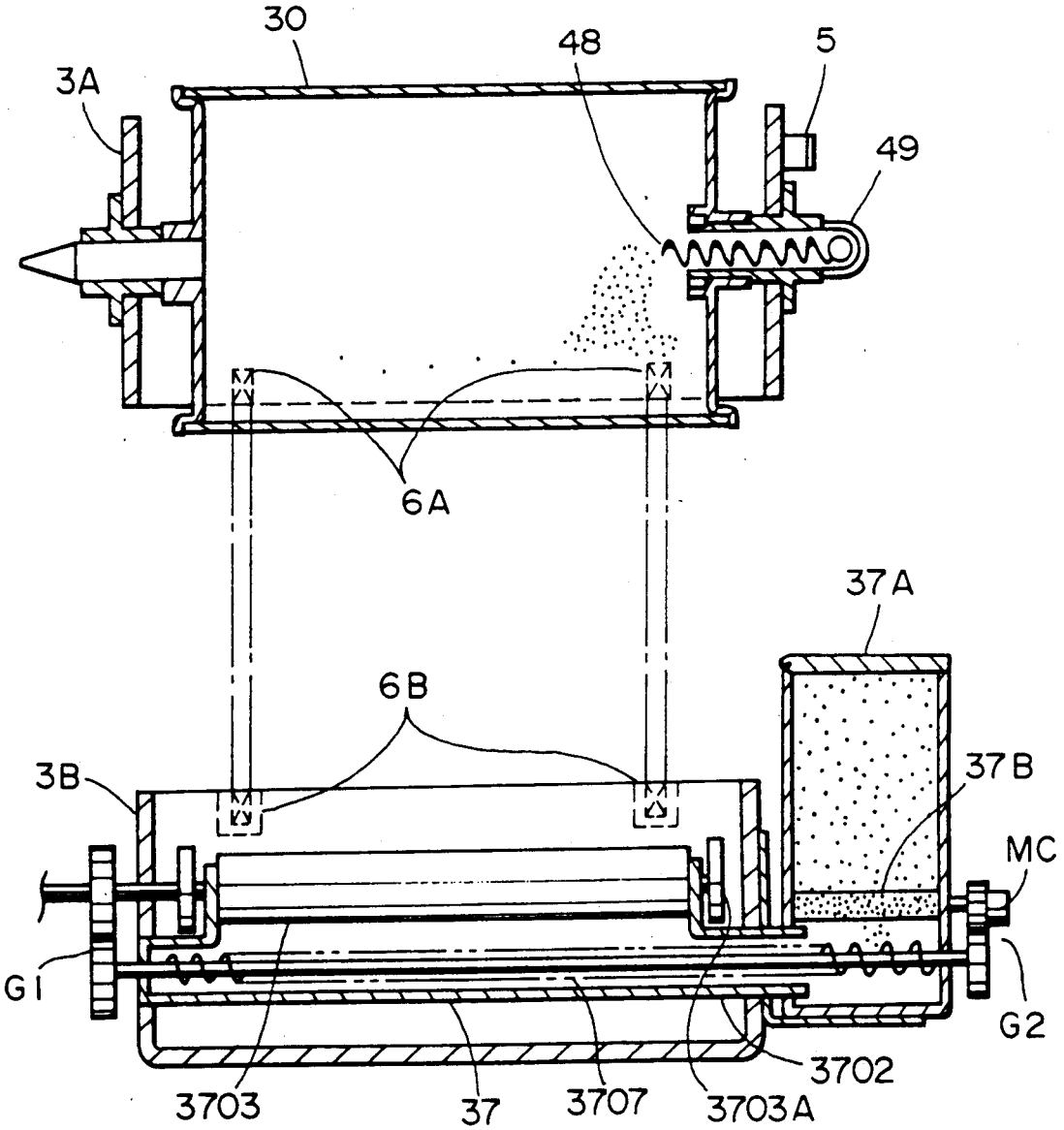

FIG. 3 is a sectional view taken along the line A—A in FIG. 2 and shows the interior of the image retainer 30 as well as the sectional structure of the connection portion between the developing device 37 and the toner supply box 37A.

In the state where the upper cartridge 3A and the lower cartridge 3B are integrated with each other, the developing device 37 is positioned so that a pair of abutting rollers 3703A disposed concentrically at both shaft ends of a developing sleeve 3703 press the image retainer 30. On the other hand, an extension portion of a housing 3702 of the developing device 37 is connected to the bottom of the toner supply box 37A.

As will be described later, the developing device 37 is equipped with a pair of toner transfer screws which agitate the toner to be stored by propelling forces in the opposite directions and one of them, such as a toner transfer screw 3707 having the propelling direction, to the left in the drawing, is extended into the toner supply box 37A.

Accordingly, when the developing sleeve 3703 starts rotating, the toner transfer screw 3707 is rotated through a gear pair G1 and a sponge roller 37B of the toner supply box 37A is rotated due to the rotation of a gear pair G2 through an electromagnetic clutch MC at the time of the drop of the toner concentration, so that the toner stored therein drops and is transferred into the developing device 37 by the propelling force of the toner transfer screw 3707.

The toner thus supplemented in the developing device 37 is mixed uniformly with the existing toner by the agitation by the toner transfer screw 3707 and the other toner transfer screw and is then supplied to the developing sleeve 3703.

The supplementation of the toner from the toner supply boxes 36A, 38A, 39A to the developing devices 36, 38, 39 is effected by the same structure and function as described above, respectively.

Since the toner boxes are arranged substantially side by side in a line, the toner can be supplied easily by opening the upper casing 1.

Each developing device used for each embodiment stores a developer having a specific color, and its structure and function are the same as those of the developer 37 of the printer which will be hereinafter described with reference to FIG. 5.

Figure 5:
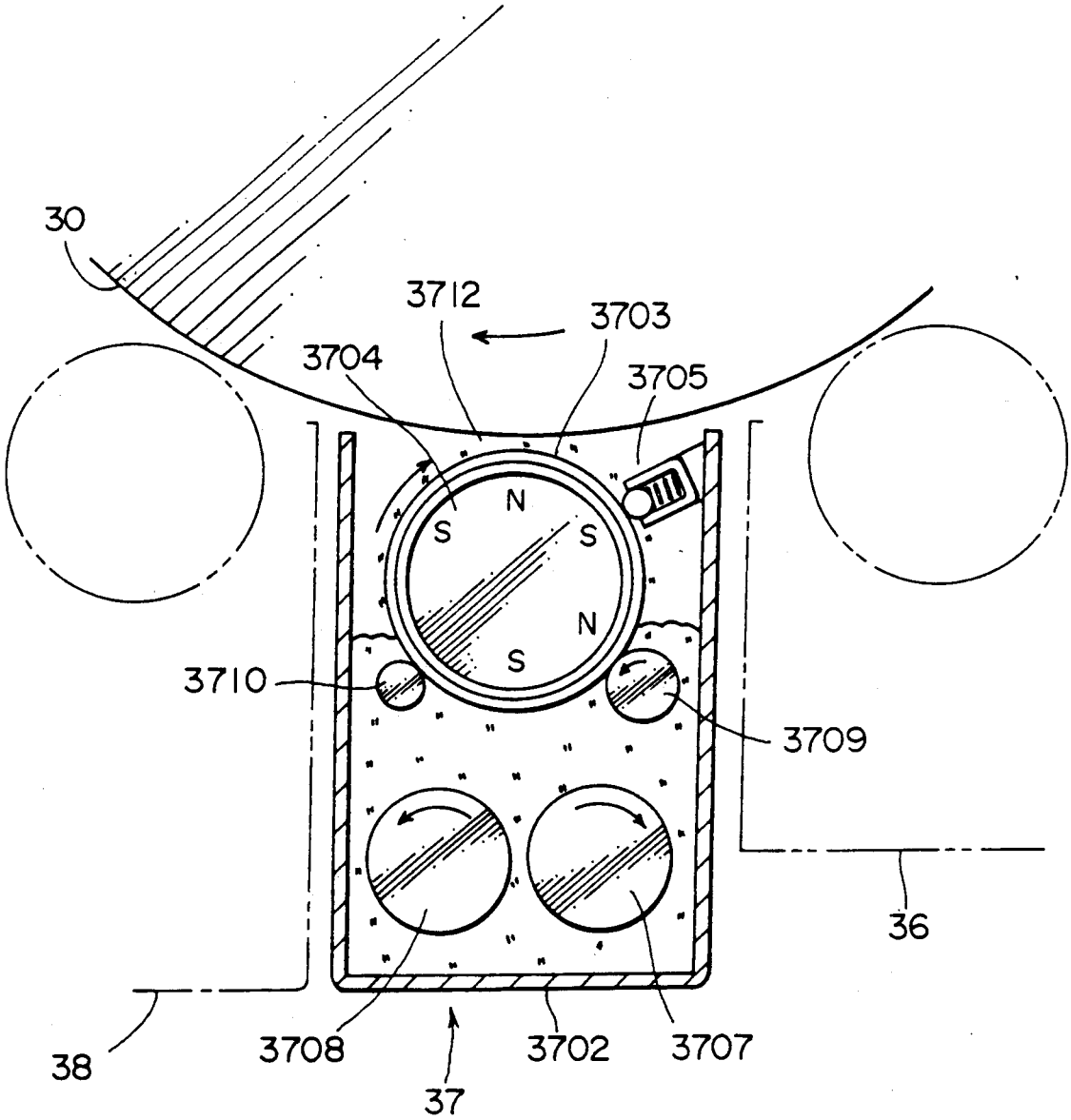
FIG. 5 is a sectional view of a developing device stored in the process cartridge described above.

In FIG. 5, reference numeral 3702 represents a housing; 3703 is a developing sleeve; 3704 is a magnet roller; and 3705 is a thin layer forming member having rigidity and magnetic property for limiting the amount of the developer. This thin layer forming member 3705 is pushed to the developing sleeve 3703 at a predetermined load in the state where the developer does not exist. Reference numerals 3707 and 3708 represent a pair of toner transfer screws having a screw structure and transferring and circulating the developer in mutually opposite directions; and reference numeral 3709 is a supply roller.

The toner supplied from the toner supply box 37A is mixed with the carrier and sufficiently agitated by one of the toner transfer screws 3707 rotating in the direction represented by the arrow and the other of the toner transfer screws 3708 rotating in the opposite direction to overlap with the other, and is then sent as the developer to the developing sleeve 3703 through the supply roller 3709.

The toner transfer screw 3707 and the toner transfer screw 3708 are the members which rotate in mutually opposite directions and function also as the agitation members. The toner and the carrier that are transferred towards the depth side by the propelling force of the toner transfer screw 3708 are shifted to the side of the toner transfer screw 3707, and then transferred to the front side of the sheet of the drawing by the propelling force of the toner transfer screw 3707. In the interim, frictional charging is effected due to the mixing of the toner and the carrier, and a homogeneous developer is formed. The developer is then adhered in a laminar form to the peripheral surface of the developing sleeve 3703 by the supply roller 3709 which is sponge-like and rotates in the direction shown by the arrow.

In this embodiment, the thin layer of the developer adhered to the peripheral surface of the developing sleeve 3703 rotating in the direction represented by the arrow (clock-wise) outside the magnet roller 3704 develops in a non-contact manner the latent image on the image retainer 30 rotating in the direction of the arrow in a developing region 3712 with a gap between them by the abutting rollers 3703A, and thus forms the toner image.

At the time of this non-contact development, a developing bias containing A.C. components from the power source not shown is applied to the developing sleeve 3703 so that only the toner in the developer on the developing sleeve 3703 is transferred and adhered selectively to the surface of the latent image.

After the toner component is consumed, the carrier ratio becomes high in the developer. The developer is transferred by the developing sleeve 3703, scraped and recovered by a scraper 3710 and is again mixed with a developer having a high toner ratio.

Figure 6:
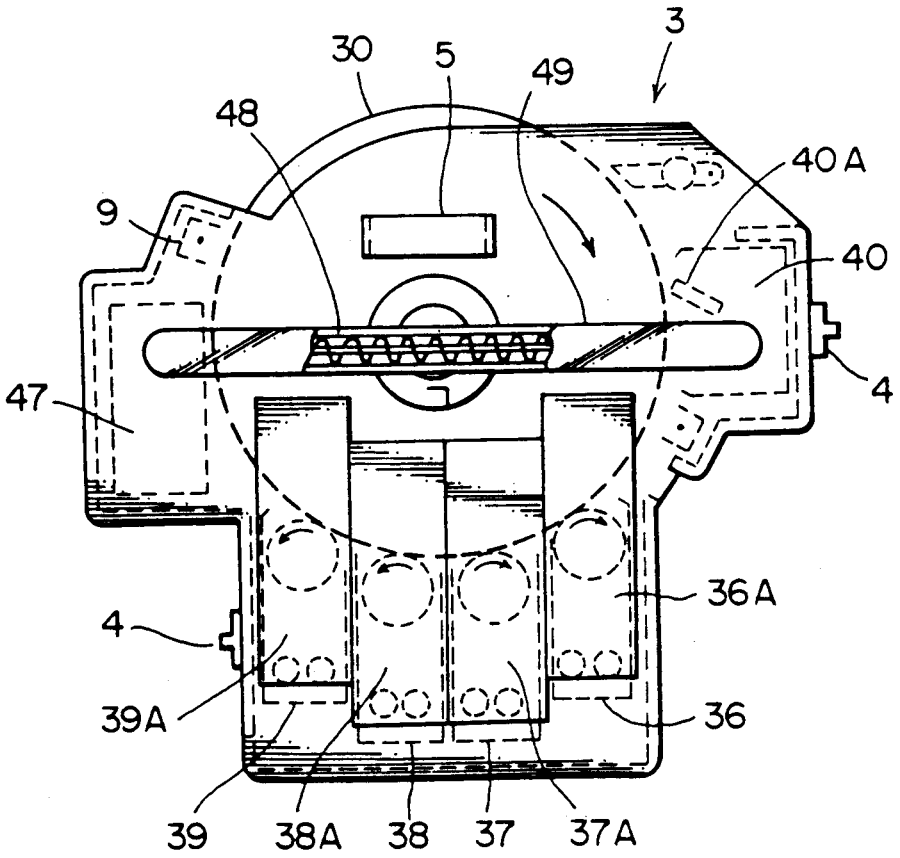
FIG. 6 is a front view of a process cartridge in another embodiment of the present invention.

FIG. 6 shows another example of the process cartridge in the apparatus of the present invention. In this process cartridge 3, the developing devices 36, 37, 38, 39 are distributed to the right and left sides with respect to the center line of the image retainer 30. In other words, the developing devices 36 and 37 are disposed on the right side of the axis of the image retainer 30 as the boundary and the developing devices 38 and 39 are disposed at the symmetric positions on the left side. Furthermore, the developing sleeves of the developing devices 36 and 37 on the right side rotate clock-wise while the developing sleeves of the developing devices 38 and 39 on the left side rotate counter-clockwise so as to effect development of the images, respectively.

Since the group of the developing devices employ the arrangement described above and furthermore, since the rotating directions of the developing sleeves are opposite to one another, good balance can be established in the horizontal direction in the aspect of the weight of the process cartridge 3 and in the aspect of its handling, so that detrimental vibration can be prevented.

Each of the developing devices disposed at the transverse symmetric position can employ the common structure, and the scraping operation of the toner from the developing sleeve can be effected extremely efficiently by the action of the gravitational force after the development is complete, so that a suitable amount of fresh toner can always be supplied.

Moreover, since a toner recovery box 47 is disposed at the symmetric positions with respect to the cleaning device 40 for the image retainer 30, the balance of the weight of the process cartridge 3 in the horizontal direction is further improved. The toner transfer pipe 49 with the built-in toner transfer screw 48 is disposed in front of the process cartridge 3 between the toner recovery box 47 and the cleaning device 40, so that the waste toner scraped off from the peripheral surface of the image retainer 30 by the blade 40A is transferred by the propelling force of the toner transfer screw 48 and is recovered into the toner recovery box 47.

In accordance with the present invention described above, the process cartridge for storing the main processing devices of the color image forming apparatus such as the image retainer, a plurality of developing devices, the cleaning device, and the like, can be freely divided and coupled in the vertical direction, and the cleaning device and the image retainer for recovering the waste toner removed by the cleaning device can be taken out upward while being connected to each other. As a result, a large quantity of the waste toner can be recovered without disposing particularly any toner recovery boxes or the like, and the waste toner can be treated by an extremely simple operation without contaminating the operator's hands and clothes. Thus, present invention can provide an easy-to-operate color image forming apparatus capable of treating the waste toner.

What is claimed is:

1. In a color image forming apparatus wherein a plurality of toner images are formed on a rotating image retainer by performing a plurality of charging, image exposure, and developments on said image retainer, respectively, and said plurality of toner images are transferred onto a recording paper, an improvement wherein;

all developing devices are disposed below said image retainer and a cleaning device is dispose above said image retainer, said image retainer, said developing devices and said cleaning device being integrated into a single process unit, toner recovered by said cleaning device being stored in said process unit, said process unit being adapted to be withdrawn from a main body of said color forming apparatus, said image retainer being adapted to be removable, in a vertical direction, from said process unit when said process unit is withdrawn from said main body.

2. The apparatus of claim 1 wherein toner recovered by said cleaning device is stored within said image retainer.

3. In a color image forming apparatus wherein a plurality of toner images are formed on a rotating image retainer by performing a plurality of charging, image exposure, and developments, on said image retainer, respectively, and said plurality of toner images are transferred onto a recording paper, an improvement wherein;

all developing devices are disposed below said image retainer and a cleaning device is disposed above said image retainer, said image retainer, said developing devices, and said cleaning device being integrated into a single process unit, said process unit being adapted to be withdrawn from a main body of said color forming apparatus, said image retainer being adapted to be removable from said process unit when said process unit is withdrawn from said main body.

4. The apparatus of claim 3 wherein respective toner supply boxes are integrally provided in parallel with said developing devices.

5. The apparatus of claim 3 wherein said image retainer is a drum-type image retainer and wherein developing sleeves provided in said developing devices rotate in a direction opposite to developing sleeves of adjacent developing devices.

* * * * *